US011260395B2

(12) United States Patent
Esbelani et al.

(10) Patent No.: US 11,260,395 B2
(45) Date of Patent: Mar. 1, 2022

(54) WEAR RESISTANT VSI CRUSHER DISTRIBUTOR PLATE

(71) Applicant: SANDVIK INTELECTUAL PROPERTY AB, Sandviken (SE)

(72) Inventors: Hodin Esbelani, Trelleborg (SE); Rowan Dallimore, Somerset (GB); Knut Kjaerran, Svedala (SE); Andreas Forsberg, Malmo (SE); Mats Malmberg, Rydsgard (SE); Oskar Larsson, Upplands Vasby (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 618 days.

(21) Appl. No.: 15/037,670

(22) PCT Filed: Oct. 27, 2014

(86) PCT No.: PCT/EP2014/072951
§ 371 (c)(1),
(2) Date: May 18, 2016

(87) PCT Pub. No.: WO2015/074831
PCT Pub. Date: May 28, 2015

(65) Prior Publication Data

US 2016/0288131 A1 Oct. 6, 2016

(30) Foreign Application Priority Data

Nov. 19, 2013 (EP) ..... 13193540

(51) Int. Cl.
*B02C 13/286* (2006.01)
*B02C 13/18* (2006.01)

(52) U.S. Cl.
CPC ..... *B02C 13/1835* (2013.01); *B02C 13/185* (2013.01); *B02C 13/1807* (2013.01); *B02C 2013/28681* (2013.01); *B02C 2210/02* (2013.01)

(58) Field of Classification Search
CPC ..... B02C 13/1807; B02C 13/1835; B02C 13/185; B02C 2013/28681; B02C 2210/02
(Continued)

(56) References Cited

U.S. PATENT DOCUMENTS 4,119,459 A * 10/1978 Ekemar ..... B23B 27/148 428/564
4,787,564 A 11/1988 Tucker
(Continued)

FOREIGN PATENT DOCUMENTS

WO 95/10359 A1 4/1995
WO 01/30501 A1 5/2001
(Continued)

OTHER PUBLICATIONS

Sanvik: "HX900 cast-in-carbide", Feb. 1, 2008 (Feb. 1, 2008), XP002721270, Retrieved from the Internet: URL:http://www.miningandconstruction.sandvik.com/0120/Internet/global/S003713.nsf/Alldos/Portals*5CProducts*Conveyors*and*conveyor*components*2AWear*protection/$file/HX900-brochure-lowres.pdf [Retrieved on Mar. 6, 2014] pp. 3,4.

*Primary Examiner* — Elaine Gort
*Assistant Examiner* — Christopher B Wehrly
(74) *Attorney, Agent, or Firm* — Corinne R. Gorski

(57) ABSTRACT

A distributor plate assembly for a vertical shaft impact (VSI) crusher is optimized for abrasion wear resistance. The distributor plate includes a plurality of plate segments, each segment being formed from a main body of ductile iron alloy
(Continued)

having cemented carbide granules embedded within the iron alloy.

16 Claims, 6 Drawing Sheets

(58) Field of Classification Search
USPC ..... 241/275
See application file for complete search history.

(56) References Cited

U.S. PATENT DOCUMENTS 5,497,951 A * 3/1996 Watajima ..... B02C 13/18 241/275
6,171,713 B1 1/2001 Smith et al.
7,028,936 B2 * 4/2006 Condon ..... B02C 13/1814 241/275
7,451,944 B2 * 11/2008 Hall ..... B02C 2/005 241/207
7,753,303 B2 * 7/2010 Hall ..... B02C 13/1842 241/275
2003/0213861 A1 * 11/2003 Condon ..... B02C 13/1814 241/275
2004/0251358 A1 12/2004 Condon et al.
2005/0016708 A1 1/2005 Herbst
2006/0011762 A1 1/2006 Dallimore et al.
2008/0135659 A1 6/2008 Condon et al.
2008/0296418 A1 * 12/2008 Dallimore ..... B02C 13/1835 241/25
2011/0024539 A1 2/2011 Strauss et al.

FOREIGN PATENT DOCUMENTS

WO 2008087247 A1 7/2008
WO 2011025432 A1 3/2011

* cited by examiner

WEAR RESISTANT VSI CRUSHER DISTRIBUTOR PLATE

RELATED APPLICATION DATA

This application is a § 371 National Stage Application of PCT International Application No. PCT/EP2014/072951 filed Oct. 27, 2014 claiming priority of EP Application No. 13193540, filed Nov. 19, 2013.

FIELD OF INVENTION

A distributor plate assembly for a vertical shaft impact (VSI) crusher and in particular, although not exclusively, to a modular distributor plate assembly comprising an iron alloy base material incorporating embedded cemented carbide granules being configured for enhanced abrasion wear resistance.

BACKGROUND ART

Vertical shaft impact (VSI) crushers find widespread use for crushing a variety of hard materials, such as rock, ore, demolished constructional materials and the like. Typically, a VSI crusher comprises a housing that accommodates a horizontally aligned rotor mounted at a generally vertically extending main shaft. The rotor is provided with a top aperture through which material to be crushed is fed under gravity from an elevated position. The centrifugal forces of the spinning rotor eject the material against a wall of compacted feed material or specifically a plurality of anvils or retained material such that on impact with the anvils and/or the retained material the feed material is crushed to a desired size.

The rotor commonly comprises a horizontal upper disc and a horizontal lower disc. The upper and lower discs are connected and separated axially by a plurality of upstanding rotor wall sections. The top aperture is formed within the upper disc such that the material flow passes downwardly towards the lower disc between the wall sections. A replaceable distributor plate is mounted centrally on the lower disc to protect it from the material feed. Example VSI crusher distributor plates are described in WO 95/10359; WO 01/30501; US 2006/0011762; US 2008/0135659 and US 2011/0024539.

As will be appreciated, due to the abrasive nature of the crushable material, the distributor plate is subject to substantial abrasive wear which significantly reduces the plate operational lifetime. Accordingly, it is a general objective to minimize the abrasive wear and to maximize the operational lifetime of the plate. U.S. Pat. No. 4,787,564; US 2003/0213861 and US 2004/0251358 describe central distributor plates having embedded carbide inserts at an upward facing plate surface. However, the plate base material is typically cast white iron and notwithstanding the incorporation of wear resistant inserts, the operational lifetime under standard operational conditions is typically 100 to 125 hours. This necessitates frequent maintenance stops in which parts of the rotor are required to be dismantled to allow plate replacement. Effectively, the white iron is eroded (or washed from) around the hard inserts such that with prolonged use, the inserts become loose and are rejected from the rotor. This accelerates plate wear and necessitates immediate repair to avoid undesirable damage of the rotor and/or other components of the crusher.

Accordingly, what is required is a VSI crusher distributor plate that addresses the above problems and offers a much longer and reliable operational lifetime.

SUMMARY OF THE INVENTION

It is an objective of the present invention to provide a vertical shaft impact (VSI) crusher distributor plate configured to be resistant to the operational abrasive wear due to contact with a flow of crushable feed material through the crusher rotor. It is a specific objective to maximise the operational lifetime of the distributor plate and to minimise as far as possible, the frequency of maintenance service intervals that otherwise disrupt the normal operation of the crusher. It is a further specific objective to provide a distributor plate that is optimised and exhibits enhanced abrasion wear resistance by comprising high hardness and wear resistant inserts that are held tightly within a base or matrix material that forms the bulk of the distributor plate so as to reduce, as far as possible, the likelihood of the cemented carbide granules from being dislodged during use.

It is a further objective to provide a distributor plate having a modular construction such that regions susceptible to accelerate wear are configured to be relatively more wear resistant than those regions that experience less wear during normal use. It is a further specific objective to configure the distributor plate with at least one redundancy barrier to withstand, for at least a predetermined time period, abrasive wear in the event of failure of one or more regions or components of the main body of the plate due to premature fracture or cracking, for example by contact with an uncrushable object fed into the rotor.

The objectives are achieved, in part, via a synergistic combination of a base material alloy that has been found to lock-in wear resistant granules to minimise the risk of such granules becoming loose and being ejected from the rotor. In particular, the inventors have observed that a base material of ductile iron alloy that incorporates nodular (spheroidal) graphite as part of the alloy structure, is effective to encapsulate cemented carbide granules within the alloy matrix such that the granules are held tightly by the base material despite appreciable wear of the base material at the regions surrounding the individual granules. Advantageously, the cemented carbide granules are conveniently embedded within the iron alloy during casting. It is possible that the complex interaction at the phase boundaries involving the nodular graphite inclusions, iron matrix and the carbide granules provide a resultant cast bulk material with excellent surface contact between the carbide granules and the surrounding alloy matrix.

The objectives are also achieved, in part, by providing plate-like wear resistant inserts (preferably cemented carbide based materials) at discrete regions of the distributor plate that are also locked and held tightly by the ductile iron alloy post-casting. It has been observed that the iron alloy is also beneficial to bind strongly to the carbide plates during casting to lock the plates in position at an upward facing contact surface of the distributor plate.

To allow convenient installation and dismounting of the distributor plate within the rotor, the present distributor plate may comprise a segmented or modular configuration with each segment optionally comprising a first cemented carbide plate-like insert. Each segment may further comprise a second wear resistant (and/or high hardness) insert positioned at an opposed downward facing surface to achieve the above objectives.

According to a first aspect of the present invention there is provided a distributor plate assembly releasably mountable to protect a disc of a rotor within a vertical shaft impact crusher from material fed into the rotor, the assembly comprising: a main body having a contact surface intended to be positioned in an upward facing direction within the crusher to contact the material fed into the rotor; characterised in that: the main body comprises: ductile iron alloy incorporating nodular graphite; and cemented carbide granules embedded within the iron alloy.

Reference within this specification to cemented carbide granules, encompasses carbide particles, pieces, chips, beads including in particular recycled carbide materials. The granules may comprise a substantially uniform aspect ratio or may be formed from particles having different or very different geometries and three dimensional profiles.

Preferably, the assembly further comprises a first abrasion wear resistant insert positioned at the main body to represent a region of the contact surface. Preferably, at least a part of the insert is positioned at a perimeter region of the main body. Accordingly, the radially outermost perimeter region of the distributor plate is configured with enhanced wear resistance due to the relative positioning of the high hardness insert.

According to the subject invention, the carbide granules are significantly smaller than the wear resistant insert such that the granules are capable of surrounding edge regions of the inserts in close touching contact. Accordingly, the granules may act to assist locking of the wear resistant inserts within each plate segment due to frictional contact.

Preferably, the wear resistant insert is a plate-like body and the main body is formed around the plate-like body at a region of the contact surface. More preferably, an upward facing surface of the plate-like insert is positioned substantially co-planar with the contact surface of the main body. Such an arrangement provides a seemingly singular contact surface that does not include raised edges, regions or entrapment zones that may otherwise provide locations for material accumulation, deflection and/or accelerated wear.

Optionally, the insert comprises a polygonal shape profile wherein at least one edge of the insert represents a region of at least one perimeter edge of the main body. In particular, and according to one specific implementation, at least two edges of the insert represent regions of two perimeter edges of the main body. The insert is specifically positioned such that the final contact between the material and the distributor plate is via the perimeter-located insert.

Preferably, the plate-like insert comprises a heptagonal configuration such that five sides of the insert are positioned in contact with the ductile iron alloy whilst the remaining two sides are exposed and define, in part, the perimeter of the distributor plate. Preferably, the insert comprises a cemented carbide material and may be a tungsten carbide based material. According to further embodiments, each insert may comprise a low friction material (relative to the segment main body) to minimise abrasive wear due to contact with the flow of crushable material.

Optionally, the assembly further comprises a second abrasion wear resistant insert positioned at a rearward surface of the main body, the rearward surface being opposite the contact surface and configured to mount the plate at the disc of the rotor. Such an arrangement is advantageous to provide redundancy wear resistance for the lower disc of the rotor and indeed the axially lower components of the central mount upon which the rotor is supported and driven. The second insert is configured to protect the lower disc in the event that the main body of the distributor plate fractures or is worn through.

Optionally, the second insert comprises a white iron alloy material. Optionally, the second insert may comprise a carbide based material or a further material having enhanced wear resistance relative to the material of the main body. Optionally, the first and second plate-like inserts comprise the same material.

Preferably, the second insert is a plate-like body positioned at the main body to represent a region of the rearward surface, wherein at least a part of the second insert is positioned immediately behind the first insert. Preferably, the main body comprises a recess at a region of the rearward surface, the second insert accommodated at least partially within the recess at the rearward surface. Optionally, the second insert is positioned at a perimeter region of the main body such that an edge region of the second insert represents an edge region of the main body at a downward facing mount surface of the distributor plate.

Preferably, the carbide granules comprise any one or a combination of the following metals: titanium, zirconium, hafnium, vanadium, niobium, tantalum, chromium, molybdenum, tungsten, manganese, cobalt, nickel.

Preferably, the carbide granules embedded in the main body penetrate from the contact surface towards an opposite rearward surface through the main body to a depth up to 50% of a total thickness of the main body between the contact and rearward surfaces. Such an arrangement is advantageous to provide maximum wear resistance at the contact surface due to the high concentration of embedded carbide granules at this axially upper region of the main body. The decreasing concentration gradient of carbide granules axially away from the upward facing contact surface is also advantageous to minimise the volume of carbide granules within the axially lower regions of the main body. Preferably, therefore the concentration gradient decreases through the main body according to a linear or curved distribution profile. Preferably, the carbide granules penetrate to a depth of up to 35% of the total thickness of the main body from the contact surface.

Preferably, the main body is modular and comprises a plurality of segments arranged in a circumferential direction around a central axis of the distributor plate assembly. More preferably, the main body comprises three segments separated and arranged around the central axis, each segment positioned in close touching contact via respective side faces. According to the preferred implementation, in a cross section perpendicular to the axis, each segment comprises a parallelogram shape profile such that two edges/faces of each segment are inward facing whilst an opposite two edges/faces define a perimeter of the distributor plate.

Preferably, the assembly further comprises a support plate having a substantially hexagonal shape profile configured to support the hexagonal distributor plate from an axially lower position. Preferably, the support plate is positioned axially intermediate the distributor plate and the lower disc of the rotor.

Preferably, each segment of the distributor plate comprises the first insert and/or the second insert positioned at the respective contact and rearward surfaces.

According to a second aspect of the present invention there is provided a vertical shaft impact crusher rotor comprising a distributor plate assembly as claimed herein.

According to a third aspect of the present invention there is provided a vertical shaft impact crusher comprising a rotor as claimed herein.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
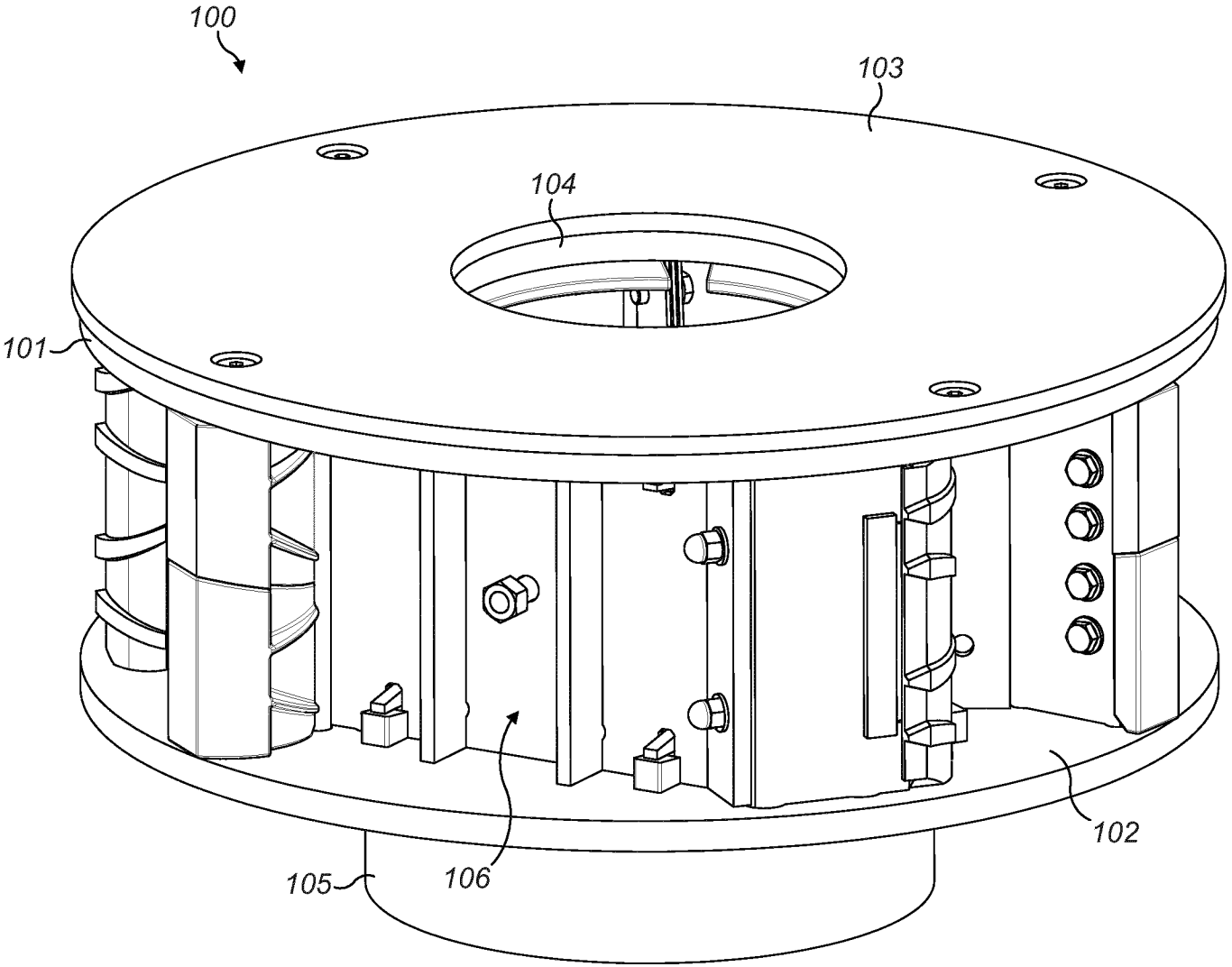
FIG. 1 is an external perspective view of a VSI crusher rotor having an upper and lower disc separated by a plurality of wall sections.

Referring to FIG. 1, a rotor 100 of a vertical shaft impact (VSI) crusher comprises a roof in the form of an upper horizontal disc 101 having an upper wear plate 103, and a floor in the form of a lower horizontal disc 102 separated by a vertical rotor wall 106. The lower disc 102 comprises a hub 105, which is welded centrally to a lower surface of disc 102 and is configured to be connected to a vertical shaft (not shown) for rotating rotor 100 within a main housing (not shown) of the VSI-crusher. Upper disc 101 has a central aperture 104 through which material to be crushed may be fed into rotor 100. Upper horizontal disc 101 is protected from crushable material impacting the rotor 100 from above by a top wear plate 103.

Figure 2:
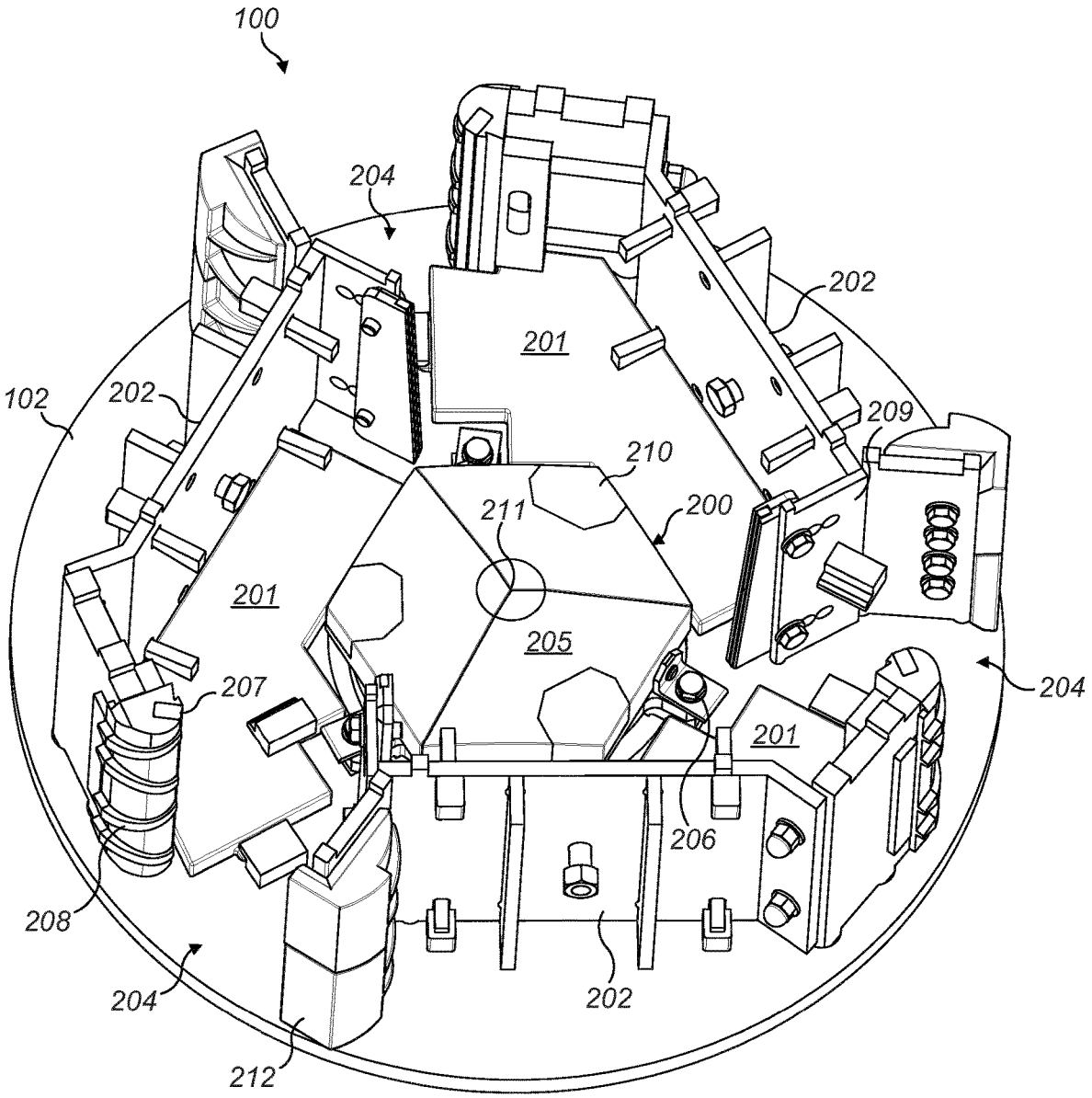
FIG. 2 is a perspective plan view of the rotor of FIG. 1 with the upper disc removed for illustrative purposes.

FIG. 2 illustrates upper disc 101 and wear plate 104 removed for illustrative purposes. Lower disc 102 is protected from wear by three lower wear plates 201. A distributor plate 200 is attached to a centre region of lower disc 102 and is configured to distribute the feed material received through aperture 104 and to protect the lower disc 102 from wear and impact damages caused by the abrasive contact with the feed material. Distributor plate 200 is modular and comprises three separate segments 205 arranged circumferentially around a central longitudinal axis 211 that extends through rotor 100 and is aligned substantially perpendicular to upper and lower discs 101, 102. Each segment 205 comprises a wear resistant insert 210 arranged at a perimeter region of distributor plate 200.

Upper and lower discs 101, 102 are separated axially by a series of rotor wall sections 202 that extend vertically between discs 101, 102 and are positioned radially outside of the lower wear plates 201. Spatial gaps are provided between wall sections 202 to define outflow openings 204 through which the feed material is ejected by the centrifugal forces of the spinning rotor 100 to contact surrounding anvils (or retained material) that act to crush the material for subsequent discharge from the crusher.

Figure 3:
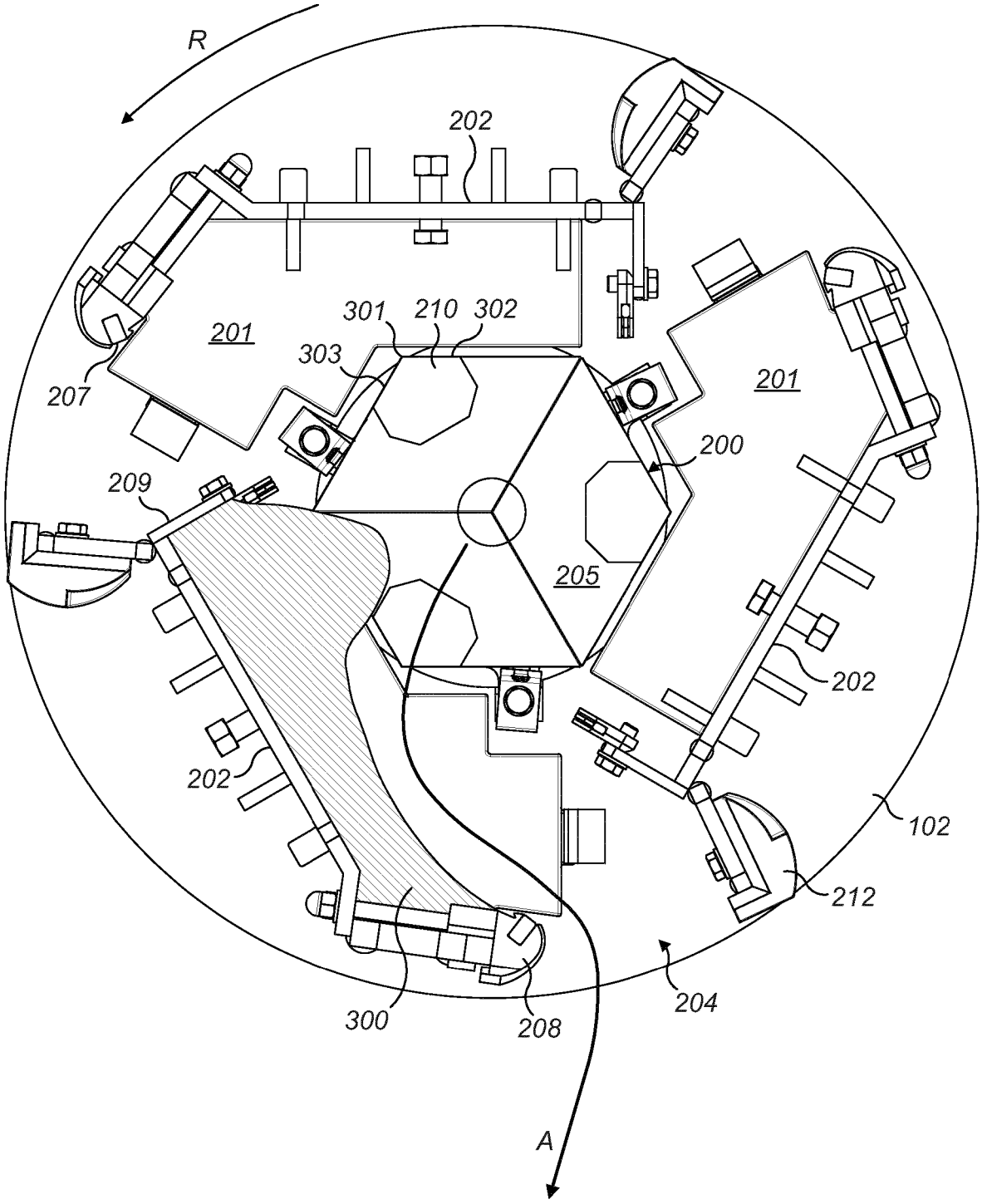
FIG. 3 is a plan view of the rotor of FIG. 2.
Figure 4:
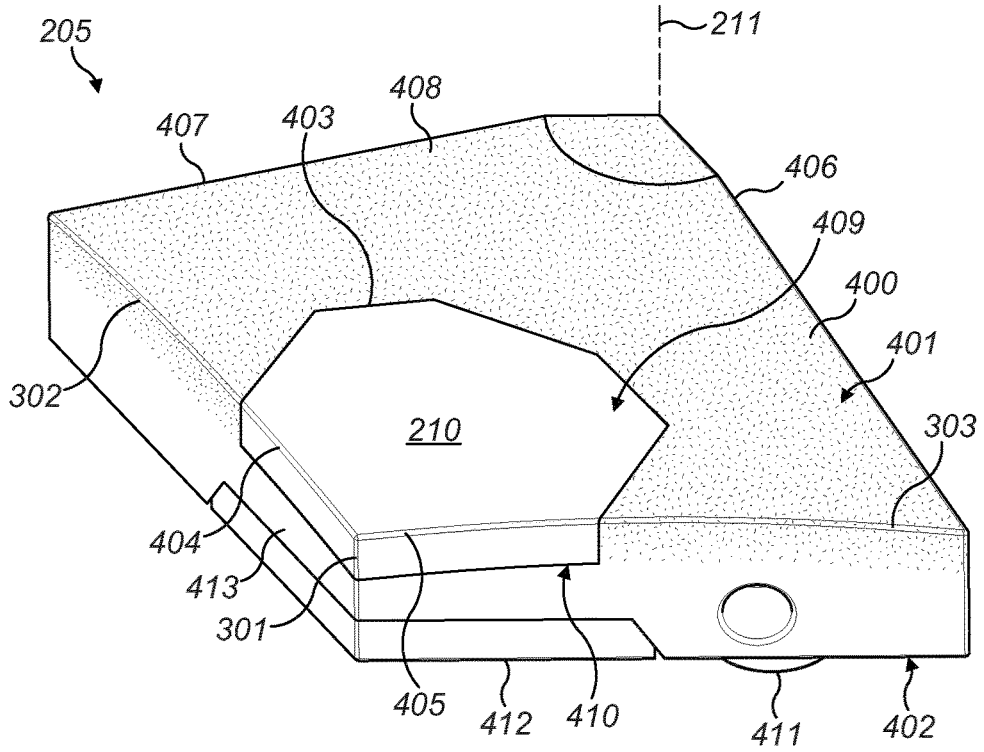
FIG. 4 is an upper perspective view of a segment of a distributor plate according to a specific implementation of the present invention.
Figure 5:
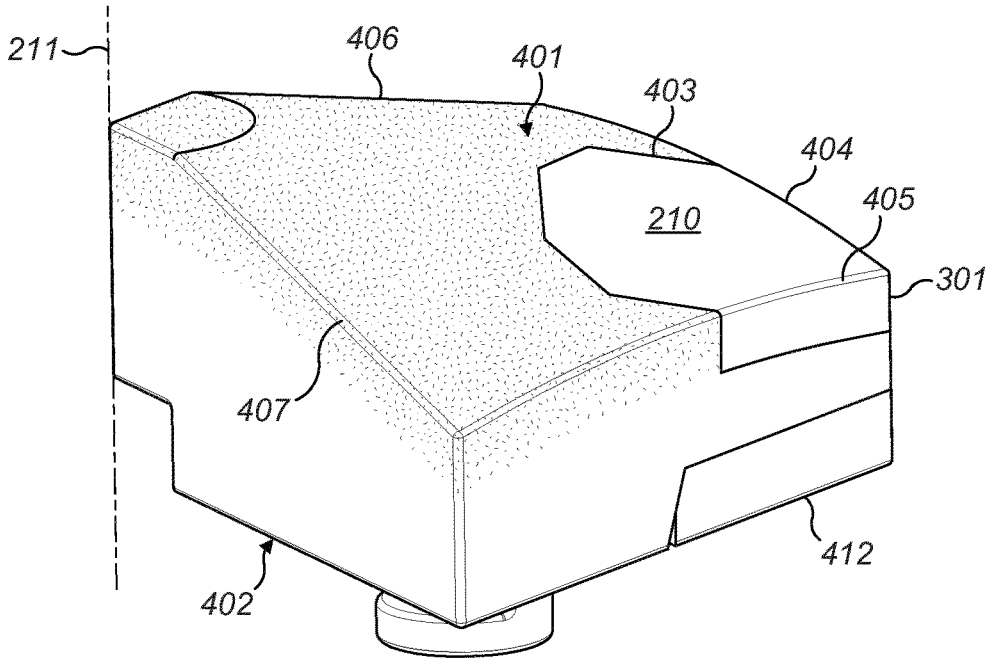
FIG. 5 is a further view of the distributor plate segment of FIG. 4 rotated about a central axis.
Figure 6:
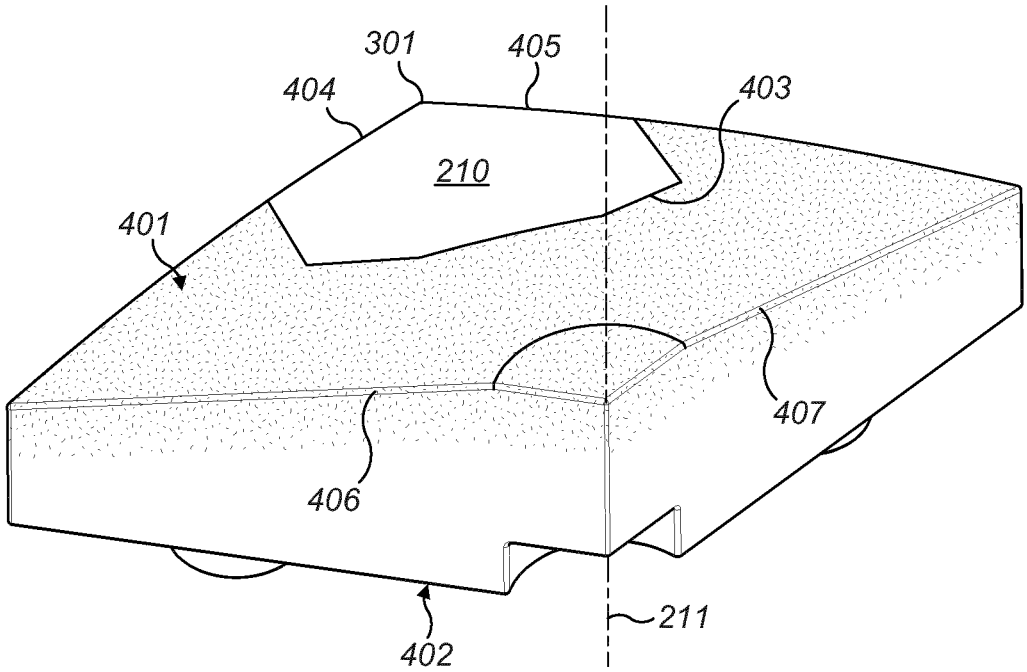
FIG. 6 is a further view of the distributor plate segment of FIG. 4 rotated about the central axis.

Referring to FIGS. 2 and 3, each wall section 202 is terminated at a leading edge side by a wear tip holder 208 that mounts a wear resistant tip 207. Holder 208 and tip 207 are also aligned substantially vertically to extend between the upper and lower discs 101, 102. Each wall section 202 further comprises a wear tip shield 212 positioned at an opposite trailing edge of wall section 202 to extend substantially vertically between the upper and lower discs 101, 102. Accordingly, material outflow regions 204 are defined circumferentially between each wear tip 207 (and tip holder 208) and an adjacent tip shield 212.

Referring to FIG. 3, arrow R indicates the rotational direction of the rotor 100 during operation of the VSI-crusher. During operation of the rotor 100, a bed of material 300 is created against each of the three wall section 202 and on top of each plate 201 (only one bed 300 is illustrated for clarity). Bed 300, formed from material that has been fed to the rotor 100 and has been trapped inside it, extends from a rear support plate 209 to wear tip 207 (and holder 208). Each material bed 300 acts to protect the wall section 202, the plate 201 and the wear tip 207 from wear and provides directional control of the ejected material. Arrow A describes a typical passage of material fed to rotor 100 via central aperture 104 and ejected via outflow opening 204. As illustrated in FIG. 3, the flow of material passing through rotor 100 travels in contact with a single distributor plate segment 205 in a generally radially outward direction from central axis 211. That is, the flow of material does not pass over the transitions between individual segments 205. More specifically, the flow A of material passes over predominantly vertex 301 formed at the junction between distributor plate edges 302, 303. Accordingly, the edges 302, 303 and vertex 301 of each segment are subjected to enhanced levels of abrasion wear relative to radially inner or other circumferential regions spaced from each vertex 301 and edges 302, 303. Accordingly, the wear resistant insert 210 is located at each distributor plate segment 205 at the region of vertex 301 and edges 302, 303. Distributor plate 200 is supported at a raised position above lower disc 102 via a mount plate (the position of which is indicated generally by reference 206) positioned immediately and directly below the distributor plate 200. The mount plate is, in turn, bolted to lower disc 102 via a locating cap screw (not shown) and locking pin and bolt set.

Referring to FIGS. 4 to 8, each distributor plate segment 205 comprises an upward facing surface 401 intended to be positioned facing towards upper disc 101 and a downward facing surface 402 for mounting against the mount plate 206. Each surface 401, 402 is defined by a pair of inner edges 406, 407 that are configured for positioning against the inner edges 406, 407 of a neighboring plate segments 205 to form the complete tessellated hexagonal shaped distributor plate 200. Surfaces 401, 402 are further defined by the radially outward facing edges 302, 303 that define a perimeter region of distributor plate 200. Each segment 205 comprises as a majority component, a main body 400. Main body 400 comprises a ductile iron alloy (alternatively turned ductile cast iron, nodular cast iron, spheroidal graphite iron, spherulitic graphite cast iron or SG iron). Main body 400 is formed as an iron alloy matrix comprising nodules of graphite and one or more nodulising elements such as magnesium for example. To provide enhanced wear resistance, cemented carbide granules 408 are embedded within the predominantly iron based main body 400 during casting to form a composite structure.

Advantageously, the cemented carbide granules 408 are distributed non-uniformly through the depth of each segment 205 in a direction of axis 211 from upper surface 401 to lower surface 402. That is, granules 408 are concentrated at surface 401 so as to decrease in concentration towards surface 402. In particular, carbide granules 408 penetrate to a depth of approximately one third of the thickness of main body 400 in the axial direction from upper surface 401 to lower surface 402. The granules 408 are however distributed substantially uniformly in the plane of segment 205 substantially perpendicular to axis 211. Additionally, according to further embodiments, the granules 408 may have a higher concentration towards outer edge regions 302, 303. Furthermore, granules 408 may comprise a higher concentration within main body 400 at a region immediately surrounding wear resistant insert 210. Carbide granules 408 may comprise any form of metal carbide including by way of example titanium-carbide, zirconium-carbide, hafnium-carbide, vanadium-carbide, niobium-carbide, tantalum-carbide, chromium-carbide, molybdenum-carbide, tungsten-carbide, manganese-carbide, cobalt-carbide, nickel-carbide.

As indicated, distributor plate 200 comprises three wear resistant inserts mounted at the uppermost plate surface represented in part by the upper segment surfaces 401. Each insert 210 is bonded to main body 400 during casting so as to bond and securely mount each insert 210 at each segment 205. Inserts 210 comprises a cemented tungsten carbide material that exhibits enhanced wear resistance relative to main body 400 and comprises a plate-like shape profile having a thickness (in the direction of axis 211) that is less than the thickness of main body 400. In particular, a thickness of each tile 210 is up to approximately one third of the thickness of main body 400. Insert 210 comprises an irregular heptagonal configuration in which five edges 403 are mounted and embedded internally within the main body 400 whilst two edges 404, 405 are radially outward facing away from axis 211 to be co-aligned with segment edges 302, 303 respectively. Insert 210 is further defined by an upward facing surface 409 and an opposed downward facing surface 410. Upper insert surface 409 is positioned coplanar with segment upper surface 401 so as to avoid the creation of any ridges at the upward spacing surface of distributor plate 200 that may otherwise deflect the flow A of material during rotation. This is achieved conveniently by the casting process in which insert lower surface 410 and edges 403 are bonded to the ductile iron main body 400. The inventors have observed that the bonded strength between insert 210 and main body 400 is enhanced due to the incorporation of the nodular graphite and/or carbide granules 408 within the ductile iron. This is advantageous as the centrifugal forces acting on insert 210 would otherwise facilitate detachment of the insert 210 during use. Insert 210 is specifically positioned at the region radially inside vertex 301 (and to each lateral side of vertex 301) such that upper surface 409 represents a contact region over which the majority of the feed material flows. In particular, due to its relative positioning, the majority of the material flow (A) leaves each segment 205 over and in contact with the two edges 404, 405. According to the specific implementation, a surface area of insert surface 409 relative to a surface area of segment upper surface 401 is in a range 10 to 50% and is preferably in a range 20 to 40%. The singular insert surface 409 therefore presents a significant portion of the upward facing surface 401 of each segment 205.

As illustrated in FIGS. 4 to 8, each segment 205 comprises a pair of relatively short cylindrical support feet 411 configured to seat into mount plate 206 so as to rotatably lock distributor plate 200 within rotor 100.

Each segment 205 further comprises a lower wear resistant inserts 412 positioned generally at segment downward facing surface 402. Each lower insert 412 is positioned to be facing mount plate 206 and provides redundancy protection for mount plate 206, lower disc 102 and hub 105 in the event of failure (cracking, excessive wear or fracture) of main body 400 and/or upper insert 210. Lower insert 412 is also positioned at a perimeter region of distributor plate 200 such that the majority of the lower insert 412 is positioned directly below upper insert 210. Each insert 210, 412 is separated in the axial direction by an intermediate region 413 of main body 400 to provide a tertiary layer structure at the region of edges 404, 405 and vertex 301 in the direction of axis 211. The relative thicknesses in the axial direction of upper insert 210, main body region 413 and lower insert 412 are substantially equal. Accordingly, a general thickness of the upper and lower insert 210, 412 is approximately equal.

Figure 7:
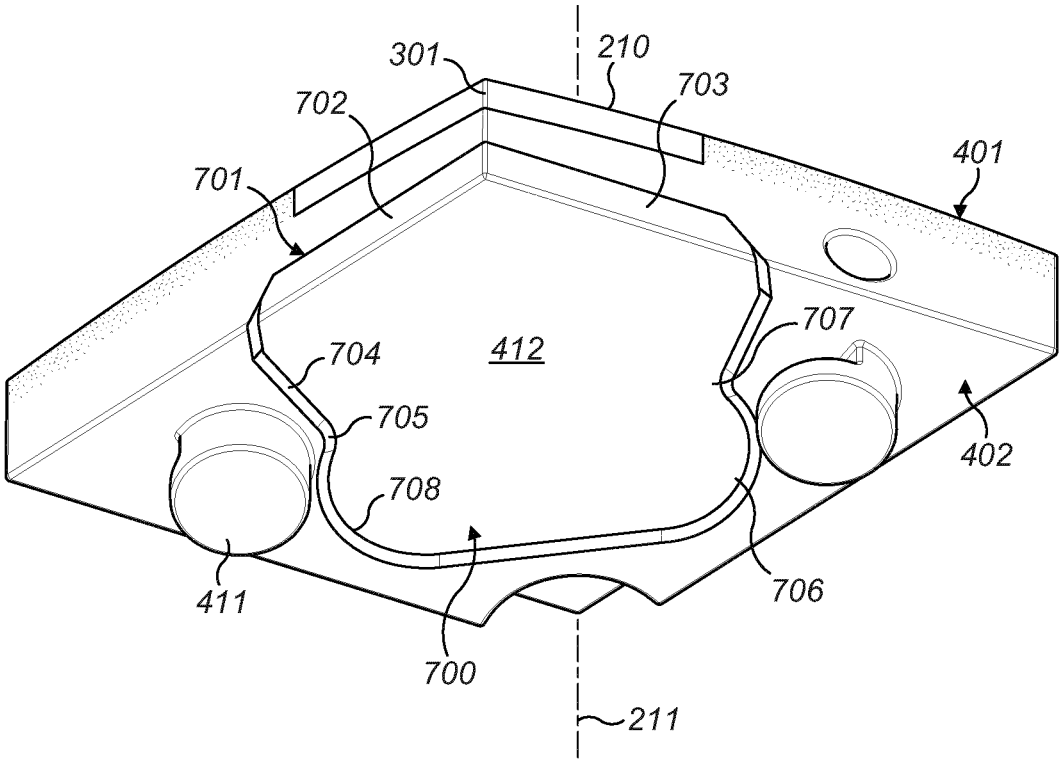
FIG. 7 is an underside perspective view of the distributor plate segment of FIG. 4 according to a specific implementation of the present invention.
Figure 8:
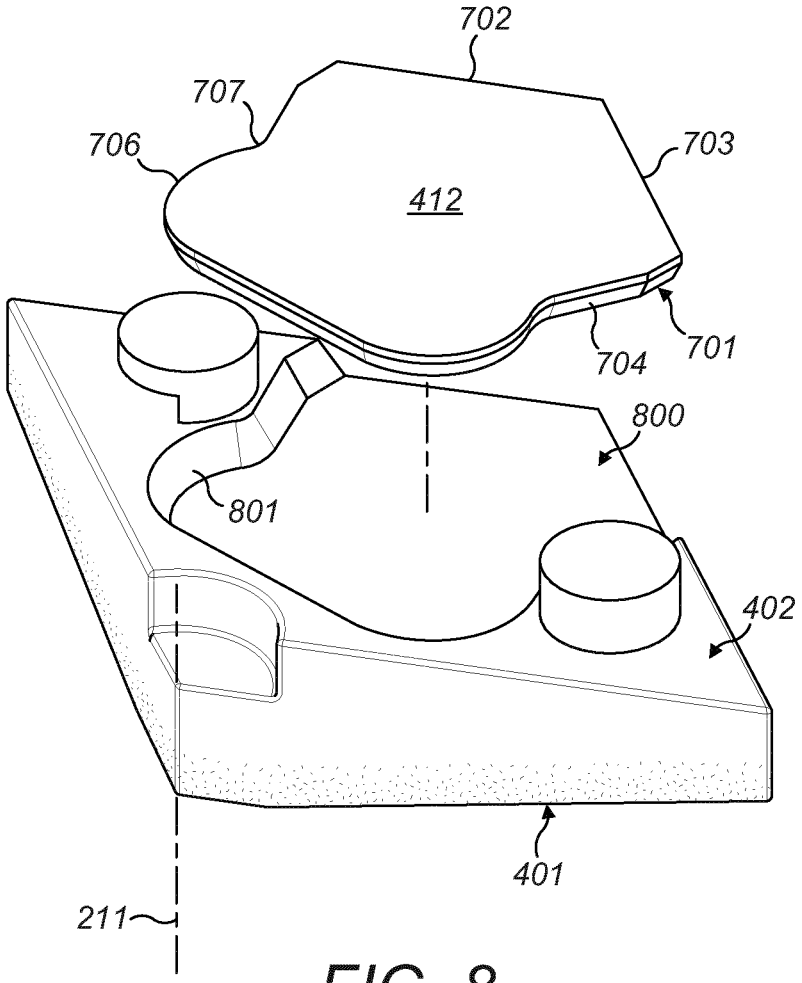
FIG. 8 is a partial exploded perspective view of the underside of the distributor plate segment of FIG. 7.

Referring to FIGS. 7 and 8, each lower insert 412 comprises a white iron alloy (alternatively term white cast iron) that typically includes a cementite phase. Unlike the upper insert 210, lower insert 412 is bonded to an underside region of main body 400 using a suitable adhesive or other chemical bonding agent. According to further specific implementations, lower insert 412 may be attached via mechanical means such as bolts, plugs, screws or pins extending axially between insert 412 and main body 400. According to the specific implementation, each lower insert 412 comprises a pair of radially outward facing edges 702, 703 configured for positioning axially below upper insert edges 404, 405. The remaining perimeter of lower insert 412 is defined by a continuous curved and/or angled inner edge 704. A recess (or groove) 800 is indented into main body 400 to extend axially inward from segment lower surface 402. A depth of recess 800 in a direction of axis 211 is slightly greater than a thickness of lower insert 412 such that a downward facing surface 700 of insert 412 is recessed relative to segment surface 402. The adhesive or bonding agent (not shown) is provided between an upper facing surface 701 of insert 412 and the segment downward facing surface 402 within recess 800. The bonding agent may also be provided between the opposed insert edges 704 and edges 801 that in part, define recess 800.

Insert 412 comprises a generally 'fish-tail' shape profile so as to wedge into recess 800 and be resistant to detachment due to the centrifugal forces created by the spinning rotor 100. That is, each insert 412 comprises a pair of tail segments 706 that extend laterally outward and rearward from an insert waist region 707. Accordingly, a radially inner region of each recess 800 comprises a flange region 705 projecting inwardly within recess 800 and a flared region 708 to mate respectively with the waist 707 and tail segments 706. Accordingly, flange 705 is configured to abut each tail segment 706 so as to lock insert 412 in position within recess 800 by mechanical frictional forces.

Accordingly, due to the specific choice of constituent materials for the distributor plate segments 205, upper and lower inserts 210, 412 and the relative shape, size and position of the inserts 210, 412 at the respective upper and lower surfaces 401, 402 the present distributor plate 200 is optimised for wear resistance in response to a continuous flow of material in direction A. In particular, under controlled test conditions, the present distributor plate 200 achieved a wear life of over 620 hours in contrast to a conventional distributor plate that achieved only 125 hours.

The invention claimed is:

1. A distributor plate assembly releasably mountable to protect a disc of a rotor within a vertical shaft impact crusher from material fed into the rotor, the assembly comprising:

a plurality of segments, each segment including a main body having a contact surface positioned in an upward facing direction arranged to contact material fed into a rotor, the main body being ductile iron alloy incorporating nodular graphite and cemented carbide granules embedded within the iron alloy, wherein the main body includes outer edges that form a perimeter region, the main body being modular, wherein the plurality of segments is arranged in a circumferential direction around a central axis; and a first insert mounted in the main body of at least one of the plurality of segments such that an upper surface of the first insert forms a part of and is coplanar with the contact surface of the main body, the first insert including at least two radially outward facing edges, the at least two radially outward facing edges of the first insert forming a part of and extending only to the perimeter region of the main body, wherein each of the at least two radially outward facing edges of the first insert is co-aligned with a respective outer edge of the perimeter region of the main body, and wherein the at least two radially outward facing edges of the first insert do not extend past the outer edges of the perimeter of the main body, the first insert being abrasion wear resistant relative to the main body.

2. The assembly as claimed in claim 1, wherein the first insert is a plate, the main body being formed around the plate.

3. The assembly as claimed in claim 2, wherein the first insert has a polygonal shape profile.

4. The assembly as claimed in claim 1, wherein the first insert is a cemented carbide material.

5. The assembly as claimed in claim 1, further comprising a second abrasion wear resistant insert positioned at a rearward surface of the main body, the rearward surface being opposite the contact surface and configured to mount the assembly at the disc of the rotor.

6. The assembly as claimed in claim 5, wherein the second insert is a plate positioned at the perimeter region of the main body to form a region of the rearward surface, at least a part of the second insert being positioned immediately behind the first insert.

7. The assembly as claimed in claim 6, wherein the main body includes a recess at the region of the rearward surface, the second insert being accommodated within the recess at the rearward surface.

8. The assembly as claimed in claim 1, wherein the carbide granules are any one or a combination of titanium, zirconium, hafnium, vanadium, niobium, tantalum, chromium, molybdenum, tungsten, manganese, cobalt, and nickel.

9. The assembly as claimed in claim 1, wherein the carbide granules embedded in the main body penetrate from the contact surface towards an opposite rearward surface through the main body to a depth up to 50% of a total thickness of the main body between the contact and rearward surfaces.

10. The assembly as claimed in claim 5, wherein each segment includes the first insert and the second insert positioned at the respective contact and rearward surfaces.

11. A vertical shaft impact crusher rotor comprising a distributor plate assembly according to claim 1.

12. A vertical shaft impact crusher comprising a rotor as claimed in claim 11.

13. The assembly as claimed in claim 2, wherein the upper surface of the first insert is positioned co-planar with the contact surface of the main body.

14. The assembly as claimed in claim 1, wherein the first insert is a low friction material relative to the main body.

15. The assembly as claimed in claim 1, wherein a surface area of the upper surface of the first insert relative to a surface area of the contact surface of the main body is in the range of 10 to 50%.

16. The assembly as claimed in claim 1, wherein one end of each of the at least two radially outward facing edges of the main body are joined to form a vertex, the first segment being located at the vertex.

* * * * *